United States Patent [19]

Schäfer et al.

[11] Patent Number: 4,521,122

[45] Date of Patent: Jun. 4, 1985

[54] NEEDLE PRINTER ASSEMBLY

[75] Inventors: Rolf Schäfer, Villingen-Schwenningen; Peter Vogelhuber, Brigachtal; Hans-Joachim Wysk, Villingen-Schwenningen, all of Fed. Rep. of Germany

[73] Assignee: Kienzle Apparate GmbH, Villingen-Schwenningen, Fed. Rep. of Germany

[21] Appl. No.: 448,020

[22] Filed: Dec. 8, 1982

[30] Foreign Application Priority Data

Dec. 12, 1981 [DE] Fed. Rep. of Germany ..... 3149300

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,592,311 | 7/1971 | Chou et al. | 101/93.05 |
| 4,044,668 | 8/1977 | Barrus et al. | 400/124 |
| 4,136,978 | 1/1979 | Bellinger, Jr. et al. | 400/124 |
| 4,225,250 | 9/1980 | Wagner et al. | 101/93.05 |
| 4,230,038 | 10/1980 | Hebert | 101/93.05 |
| 4,233,894 | 11/1980 | Barrus et al. | 400/124 |
| 4,348,120 | 9/1982 | Isobe et al. | 400/124 |
| 4,377,348 | 3/1983 | Isobe et al. | 400/124 |
| 4,389,127 | 6/1983 | Bellinger | 101/93.05 |

FOREIGN PATENT DOCUMENTS

| | | | |
|---|---|---|---|
| 0027362 | 3/1981 | Japan | 400/124 |
| 0015980 | 1/1982 | Japan | 101/93.04 |
| 0093168 | 6/1982 | Japan | 101/93.05 |

*Primary Examiner*—Edgar S. Burr
*Assistant Examiner*—M. J. Hirabayashi
*Attorney, Agent, or Firm*—Toren, McGeady, Stanger

[57] ABSTRACT

A needle printing device having a plurality of printing needles mounted in electromagnets with a permanent magnet operating through a yoke to retain a spring upon which the needles are mounted against the core of the electromagnet, the spring having an armature thereon which is released when the electromagnet is energized to permit the needles to be driven into printing position by operation of the spring. The particular features of the invention involve a construction wherein the yoke means is formed in two parts, with the first part having a surface which is formed in a common plane with a surface of the core of the electromagnet, the second part of the yoke having a surface which lies in a common plane with a surface of the armature when the electromagnetic is de-energized with the armature held against the core of the electromagnet.

12 Claims, 4 Drawing Figures

NEEDLE PRINTER ASSEMBLY

The present invention relates generally to printing systems and more particularly to a needle printer system having a construction which facilitates assembly thereof. The invention also relates to a method for mounting such a needle printing system.

In the prior art, particularly in U.S. Pat. No. 4,225,250, there is disclosed a mosaic needle printer having a compact design wherein the needle elements are retained in a rest position at which they do not cooperate with a record carrier. The needle elements are retained in this position by means of a segmented permanent magnet, the printing needles being elastically pretensioned and quickly moved to the printing position by excitation of an electromagnet counteracting the corresponding magnetic field of the permanent magnet. The individual recording and printing elements in this device are soldered to individual segments of an armature disc provided with slots and they move in slotted recesses of a yoke part which constitutes a front plate closing the printing head at the front side of the printer.

Since the printing elements are carried by print hammers, which are segments of the armature disc, they have no defined position resulting from their structural configuration and it is therefore quite difficult to arrange the printing elements at the segments in the mounting process so that the points of the printing element are in the desired printing position relative to the record carrier. The printing elements should be arranged in one or two rows vertically above each other and so that they are guided in the recesses of the segmented front plate. With such an arrangement, it is possible to maintain equal air gaps between the printing elements and the slots in the segmented front plate. If there are no such air gaps, the printing elements will be unable to move since the front plate will be magnetized and will tend to retain them in position.

In devices of the prior art such as that described herein, it is especially difficult to fasten the printing elements on the segmented armature disc in a correct position when a defined position of the printing element with respect to the carrier is to be achieved. The printing elements must be arranged exactly in one or two rows which is normally a necessary prerequisite in needle printers. In this case, it is almost impossible to make the front plate of such design that its tolerances will enable the printing elements to be fastened at the segments of the armature disc in the correct position.

In addition to the problems discussed above, there also arises difficulty in maintaining the air gap between the segments of the armature plate and the cores of the electromagnets. In such a case, it is necessary to indiviually adjust the cores of the electromagnets so that when the magnets are energized, the segments of the armature plate will be maintained under tension at the cores of the electromagnets under the effect of the permanent magnets. However, it is found that the magnetic effectiveness of the device is reduced not only due to small differences in the air gaps between the core of the energized electromagnets and its armature, but also because a slanted position of the armature occurs relative to the core of the electromagnets.

A further disadvantage of the prior art is that when one of the printing elements becomes worn, the entire armature plate with its printing elements must be exchanged. Since not all of the printing elements are operated an identical number of times, certain printing elements must be replaced more often than others.

Accordingly, the present invention is directed toward improvements in prior art devices whereby advantageous assembly conditions may be achieved. Systems in accordance with the invention may be designed so that they can be selectively combined to a printing head wherein the needles are arranged one below the other in one or two rows or so that they may be arranged in one row so as to arrive at a line printer.

The invention is also directed toward provision of a needle printing system wherein individual needles which are exposed to unusual wear may be individually exchanged thereby providing advantageous repair conditions for the entire printing system.

SUMMARY OF THE INVENTION

Briefly, the present invention may be described as a needle printing device comprising a base plate of magnetic material, a plurality of printing needles, electromagnetic means including core means operating to individually actuate each of said printing needles, permanent magnet means, yoke means for bridging an air gap between said electromagnetic means and said permanent magnet means, armature means, and spring means connected with said armature means and having said printing needles attached thereto. The armature means is held against the core means of the electromagnetic means in a first position by the permanent magnet means against the force of the spring means when the electromagnetic means is de-energized, with energization of the electromagnetic means operating to cause the printing needles and the armature means to be moved toward a printing position under the influence of the spring means. In accordance with the present invention, the yoke means is formed with a first and a second yoke part, with the second yoke part having the armature means arranged thereon, the first yoke part and the core means having surfaces which are arranged to extend in a common plane, the armature means and the second yoke part having surfaces which are also arranged in a common plane with the surface of the armature means lying in abutment with the surface of the core means when the electromagnetic means is de-energized with the armature means held in the first position.

The permanent magnet means may consist of one or several permanent magnets which are associated with the printing needles either individually or in common as well as an electromagnet with one core each attributed individually to each printing needle. The yoke means operate to bridge the air gap between the poles of the permanent magnet means and the electromagnets whereby the permanent magnets draw the armature against the core of the nonenergized electromagnetic means by means of a tensioned spring and the spring allows the armature to quickly move forward to the printing position when the electromagnet is energized.

The invention is particularly characterized in that, on the one hand, the poles of the first yoke parts which partially bridge over the air gap between the permanent magnets and the electromagnets and the poles of the cores of the electromagnets are arranged in a common plane and that, on the other hand, the armatures are arranged in a second yoke part and that the poles of this second yoke part and the pole of the armature in its pretensioned position while the electromagnet is not energized are also arranged in a common plane.

The arrangement of the poles of the first yoke part and of the cores of the electromagnets in one plane provides the advantage that there will be no tolerances between these parts. The same applies to the second bridging part, i.e., the second yoke part with its armature. Here there can also be no tolerances so that when the electromagnet is energized, there is an exact air gap. When the electromagnet is not energized, the armature lies coincidentally on the core of the electromagnet while the spring is tensioned without giving rise to slanting of the armature.

As a result, the system will be magnetically very effective and simultaneously mounting of the parts in their geometrically desirable position at various points defining the air gaps is fully defined. The force of the permanent magnet is used in an optimal manner and the life and function of the individual needle printing system is essentially increased since the armatures impact on the core of the electromagnet along surfaces which are essentially parallel or in a common plane.

In accordance with a further feature of the invention there is also provided a dampening detent in order to dampen the kinetic energy of the spring. This dampening detent and the armature in the rest position are also arranged in a common plane with the poles of the first yoke part and of the cores of the electromagnets so that with such an arrangement of the dampening detent, there are no tolerances required and no adjustments necessary.

In order to enable exchange of individual needles which are particularly subject to excessive wear, it is provided in accordance with another feature of the invention that each armature is individually associated with a second yoke part so that individual systems can be separately mounted.

During the assembly of the device of the present invention, it is possible to mount as one unit the base plate, the cores of the electromagnets, the permanent magnets, and the first yoke part, and it is also possible to treat the poles of the yoke parts and of the cores so that they will lie in a common plane. Additionally, if the dampening detent is to be arranged in a common plane with the poles of the yoke and of the cores, then the dampening detent may also be simultaneously treated or smoothed so as to have its surface leveled to lie in this common plane.

Furthermore, during the production process it is also necessary that the armature be leveled, while the spring is under tension and with the armature arranged individually in its associated yoke part, so that the bottom side of the yoke part and of the armature will also lie in a common plane. Thus, when the electromagnet is not energized, the armature will lie level or flush on the core of the magnets without tilting or slanting.

The method in accordance with the invention has an additional advantage in that the assembly of the armature and of its corresponding yoke part may be accomplished without the disadvantageous influence of the force of the electromagnet.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
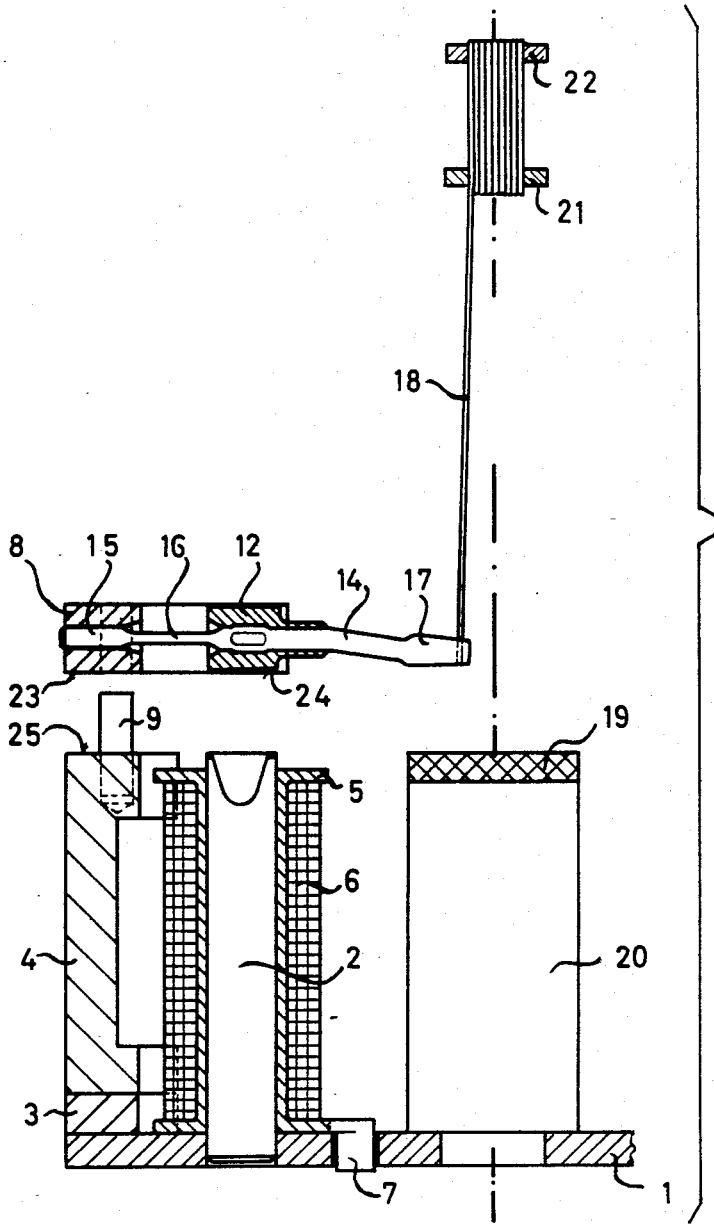
FIG. 1 is a sectional view taken through a needle printing system in accordance with the invention.
Figure 2:
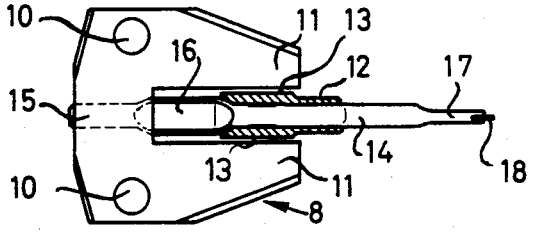
FIG. 2 is a top view of a yoke part containing an armature, partially in section.

A system in accordance with the present invention is depicted in FIGS. 1 and 2, and as seen therein each of the systems of the invention comprise a base plate 1 of magnetically conductive material with electromagnetic means mounted on the base plate 1, the electromagnetic means including an electromagnetic core 2, and electromagnet bearing part 5, and an electromagnet coil 6.

At the rim of the base plate 1 there is provided permanent magnet means arranged either as a plurality of individual magnets 3 each attributed to one of the devices or as a common permanent magnet, as will be described more fully in connection with FIG. 3.

The system of the invention includes yoke means including a first yoke part 4 which serves to partially close the magnetic circuit between the electromagnetic means 2, 5, 6, the base plate 1, the permanent magnet 3, and the yoke part 4. The bearing part 5 for the electromagnetic coil 6 is also fastened on the base plate 1 and in order to guide the ends of the coil 6, there is provided a tubular part 7 at the coil carrier or bearing part 5.

The system also includes a second yoke part 8 and in order to fasten the second yoke part 8 on the first yoke part 4, openings are provided in the yoke part 4 for introducing therein bolts 9. The second yoke part 8 is particularly best seen in FIG. 2, and is provided with two openings 10 in order to hold the yoke part 8 in place on the yoke part 4. The yoke part 8 has two projecting pole pieces 11 which surround an armature 12, the pole pieces 11 being located on both sides of the armature 12 so that between the armature 12 and the two pole pieces 11 there will be maintained a uniform air gap 13.

The armature 12 is made of an especially easily magnetizable material such as Vacoflux in the form of a rectangular part having a round bore. A spring 14 made of round steel is inserted by an end 15 thereof into a corresponding recess in the second yoke part 8. The spring 14 is formed with a necked portion 16 which enables the spring 14 to bend while simultaneously ensuring that the armature 12 with the spring 14 will have the necessary transverse stable position in the direction of the two pole pieces 11 in the yoke part 8 so that contact between the pole pieces 11 and the armature 12 is avoided. At the spring 14 there is another necked portion 17 which extends generally perpendicularly to the necked portion 16 and which serves to enable soldering thereon of printing needles 18. An intermediate smaller necked portion serves for fastening the armature thereon.

In order to dampen oscillatory movement of the printing needle and of the spring which occurs when the printing needle returns to its tensioned rest position, a dampening detent 19 is provided which is arranged on a post 20 mounted on the base plate 1. Two guide parts 21 and 22 serve to guide the printing needles 18 in a converging direction toward the printing support.

In the operation of the system of the invention, when the electromagnet 2, 5, 6 is not energized, the spring 14 will be bent between the necked portion 17 and the armature 12 and the printing needle will be brought to rest against the damping detent 19 in its retracted position. Additionally, it will be seen that the armature 12 is slightly slanted when the spring 14 is in its untensioned position. This indicates that a pole 23 of the yoke 8 and a pole 24 of the armature 12 will be of such a slanted configuration that in the tensioned position of the spring 14 with the electromagnets 2, 5, 6 not energized, when the armature 12 lies on the magnetic core 2 there is no slanting of the armature 12 so that both parts will be lying tightly together. This means that the force of the permanent magnet is utilized to its utmost degree which also provides an improvement in the effectiveness of the entire system since exactly defined currents will be required for the electromagnet 2, 5, 6 in order to counteract the force of the permanent magnet 3 and the release the printing needle 18 for a printing operation.

It will further be seen from FIGS. 1 and 2 that the system comprising the spring 14 and the armature 12 is generally symmetrical essentially in the direction of the axis of the spring so that there will be practically no slanting movement on the armature.

Thus, when the electromagnetic coil 6 is de-energized, the armature 12 will be drawn by the force of the permanent magnet 3 so that the armature 12 will rest against the core 2 and the necked portion 17 of the spring 14 will rest against the dampening detent 19. This will cause the spring to be bent thereby applying a spring biasing force to the printing needle 18 in the direction of a printing operation. Upon energization of the coil 6, the force of the permanent magnet will be overcome and the armature 12 will be released thereby causing the spring to urge the needle 18 through a printing operation.

During assembly of the needle printing system of the invention, the parts 1, 2, 3, 4, 5, and 6 as well as the parts 20 and 19 are premounted as a unit without the bearing bolts 9. Subsequently, this premounted or preassembled unit is leveled by a grinding operation so that the dampening detent 19, the poles of the cores 2 of the electromagnets and the pole 25 of the yoke part 4 are in a common plane without tolerances. The yoke part 8, the spring 14, and the armature 12 are also premounted with the spring 14 being first provided with the necked portion 16 so that the spring 14 may be introduced with its end 15 into the recess in the yoke part 8 until it is firmly mounted.

The armature 12 is then slipped over the spring 14 which is inserted into the bore in the armature 12 until the armature 12 and the spring 14 are firmly affixed together due to the necked portion 16. Thereafter, the spring 14, as may be seen from FIG. 1, will be slightly bent and at the necked portion 17 there may then be applied the printing needle 18 by soldering.

The spring 14 is then tensioned and the result will be that the armature 12 will project from the yoke part 8 to a certain unequal extent. The part 8 is then leveled or smoothed with the part 12 so that the bottom side 24 of the armature 12 will be exactly in the plane of the pole 23 of the yoke part 8. Here again the tolerance is zero and as soon as the yoke part 8 has been mounted on the subsequently applied bolts 9 on the yoke part 4, the armature 12 will lie level with its bottom side 24 on the core 2 of the electromagnetic means without any air gap and without being skewed with respect thereto. Since the armature 12 in the tensioned position of the spring 14 is absolutely coplanar with the core 2 without any air gap therebetween, erosion between the armature and the core will be avoided which will significantly improve the effectiveness and simultaneously reduce wear. Should there nevertheless occur some wear, this will occur evenly over the entire surface and will not have any detrimental effect as the printing needles 18 at the end of the spring 14 will penetrate into the dampening detent 19. The entire system requires no adjusting operations either for securing the necessary air gaps between the armature 12 and the two pole parts 11 of the yoke part 8 or between the armature 12 on the one hand and the core 2 of the electromagnetic means on the other hand. Only by a clamping effect of the spring 14 is the armature 12 mounted. No screw connections are used when mounting the entire system.

Figure 3:
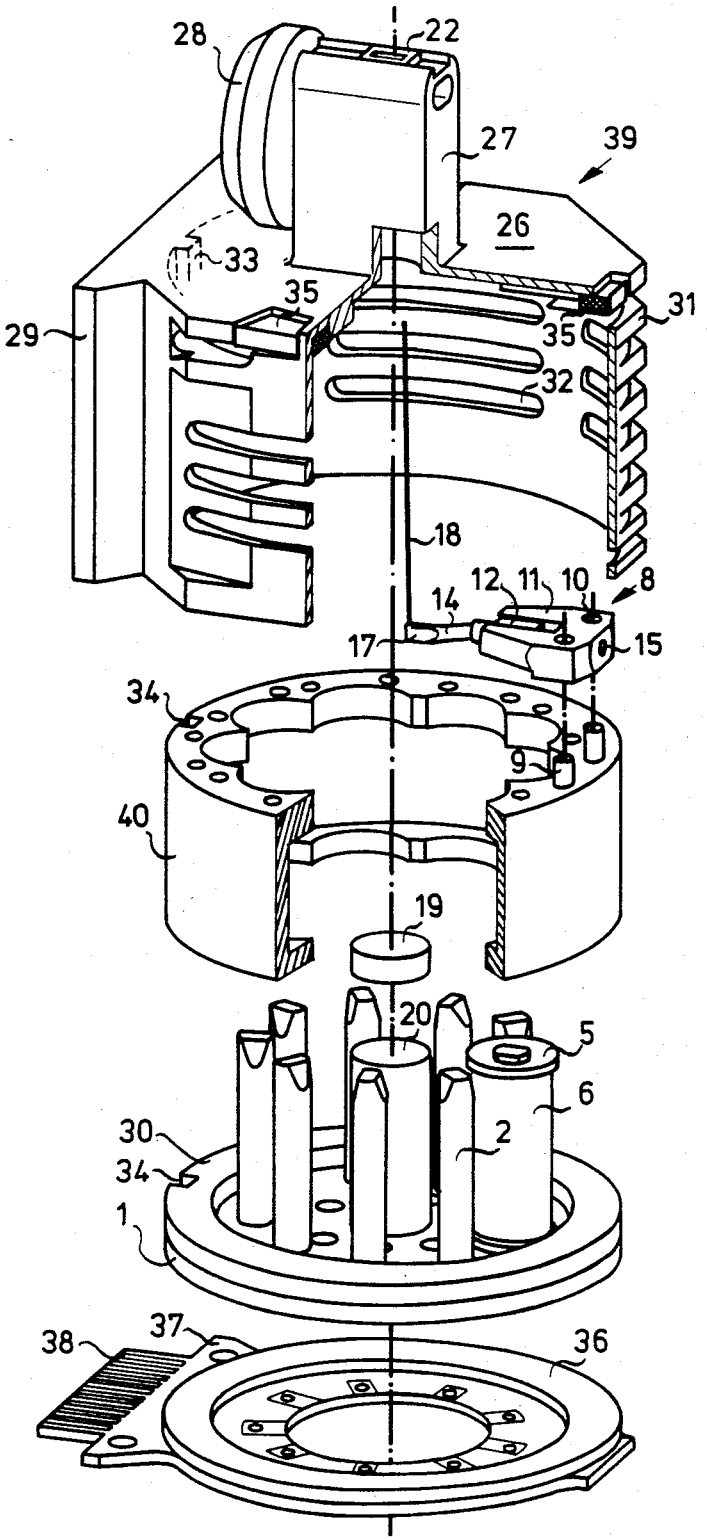
FIG. 3 is an exploded perspective view of a system of the type shown in FIG. 1 with some modifications.
Figure 4:
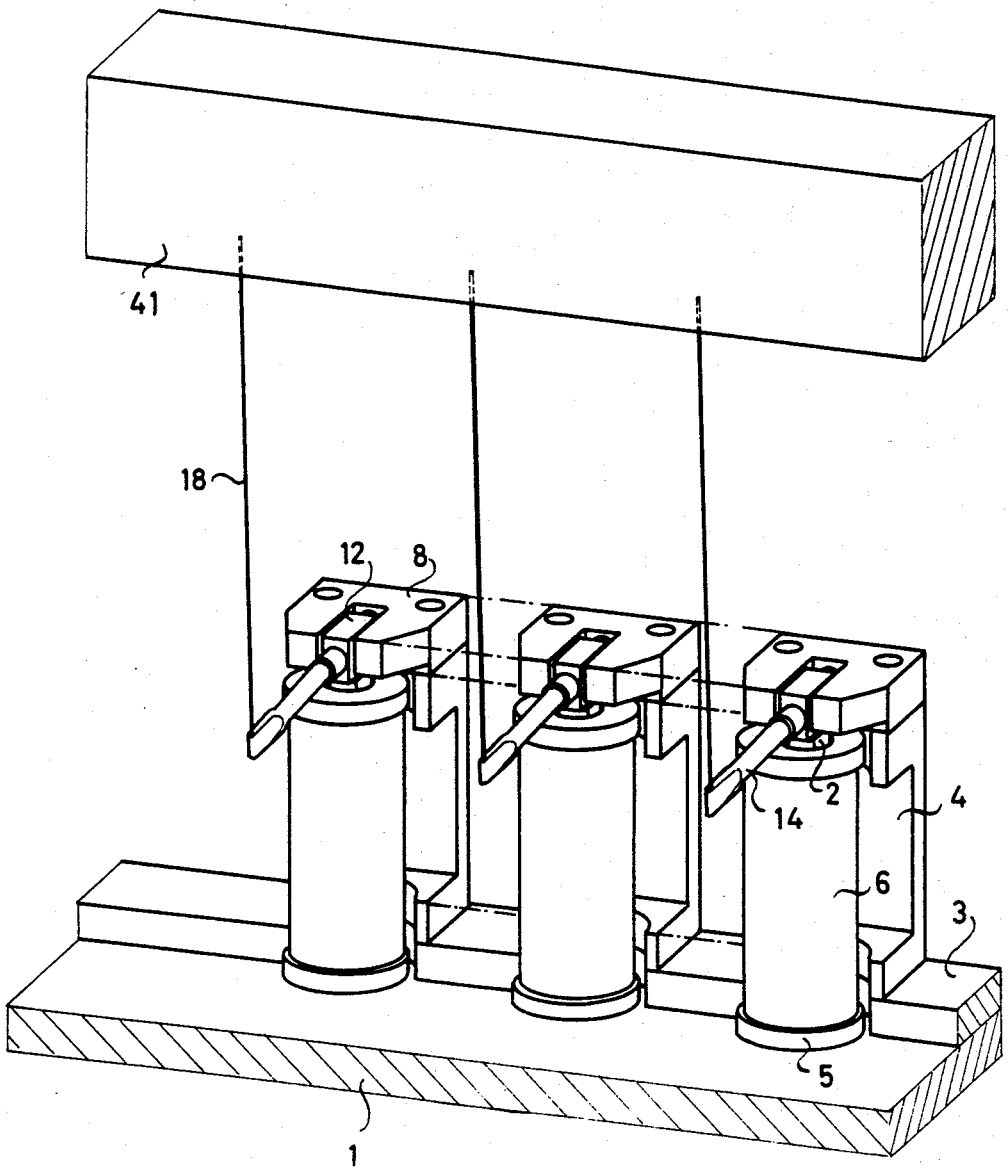
FIG. 4 is a perspective view showing an arrangement wherein a plurality of needle printing systems are assembled in a row to form a line printer.

With reference to FIGS. 3 and 4, it may be shown that the individual needle printing systems of the present invention can be composed into a complete system. FIG. 3 particularly shows a needle print head which differs from the needle printing system according to FIGS. 1 and 2 in that the first yoke part 4 is formed in the shape of a cage or housing member 40 which surrounds a plurality of electromagnets each composed of a core 2, a coil 6, and a bearing part 5. Also, the permanent magnet means in the embodiment according to FIG. 3 is different from that of FIG. 1 in that instead of a single magnet 3 associated with each individual system, there is provided in the embodiment of FIG. 3 a permanent magnet in the shape of an annular magnet 30 which is axially magnetized.

Otherwise, the needle print system according to FIG. 3 is basically similar to the system according to FIGS. 1 and 2.

The system of FIG. 3 includes a housing 39 having a front facing surface 26 which is provided with a mouthpiece 27 in which a guide part 22 for the needles is arranged. Under the mouthpiece 27 there is provided a sensing roller 28 which serves to sense paper thickness so that the exact printing distance between the front edges of the printing needles 18 and the printing support may be adjusted. The housing in its lower part is provided with dovetail projections 29 by means of which the housing may be engaged by detent means. Projections 31 and recesses 32 in the housing 39 ensure that the system will be cooled to a sufficient extent when its temperature rises due to long operating periods. In the interior of the housing there is provided a projection 33 which operates to maintain it in position and to guide the cage part 40 with the annular magnet 30 and the base part 1 by means of recesses 34. Between the housing 39 and the yoke parts 8 there is provided a rubber ring 35 which elastically holds the systems together. A similar rubber ring 36 is also arranged under the base part 1 between the base part 1 and a printed circuit plate 37 for guiding out the ends 38 of the coils 6 of the electromagnetic means. Apart from the magnetic force of the permanent magnetic means 30, the rubber rings 36, 35 maintain the parts in relative position to each other.

Except for the first yoke part 40 and the annular magnet 30 shown in the system according to FIG. 3, the basic principles of the system may be applied in a manner shown in FIGS. 1 and 2 with individual permanent magnets and with individual yoke parts 4. The drawings will clearly show that the assembly of the entire needle print head may be effected without requiring screwing or threaded connections. Corresponding individual parts may be assembled and maintained in appropriate relative position with respect to each other and with respect to the housing.

Since every needle is individually mounted and retained in its yoke part 8, it is possible to exchange this yoke part with its armature and the needle when a needle is broken or when it has become worn so that it may be unable to provide further appropriate printing operation.

FIG. 4 shows the printing system of the invention used in an assembly to form a line printer. The base plate 1 is, in FIG. 4, formed as a longitudinal part and the individual needle printing systems are mounted on this part adjacent each other spaced at a certain distance. The printing needles 18 cooperate with a printing support 41 and, to produce indicia, the entire unit of the printing system may be either moved by the distance between two printing needles or the printing support may be moved by the same distance from right to left or from left to right. Simultaneously, naturally a transport of the record carrier perpendicular to the line direction is required. By each movement of the printing needle systems by the distance of two printing needles 18, one line may be printed.

Without constrictive modifications or the like, it is possible with the needle printing system of the invention to realize different needle strokes in that the air gap between the armatures 12 and the core 2 of the electromagnetic means is a little smaller or a little larger. This is especially necessary when for example in a pass book printer for instance on the right side of the book there are more leaves and therefore a thicker printing support than on the left side of the book.

Thus, in accordance with the present invention, a needle system may be provided having the highest possible effectiveness which is especially easy to assemble. The driving magnet system comprises the permanent magnets 3 with the electromagnetic magnet means 2, 5, 6 and when the electromagnetic means is not energized, the permanent magnet means 3 will retain the printing needles 18 resiliently spring biased so that when the electromagnetic means is energized, the needles are actuated into a printing operation. The permanent magnet means and the electromagnetic means are made with the first yoke parts 4 as a base part so that the poles of the yoke parts 4 and of the cores 2 of the electromagnetic means will lie in one plane. Also in one plane will be the poles of the separately mounted second yoke part 8 with the armature 12 fastened thereto. This will allow mounting of the part without tolerances and adjustments or the like. The damping detent 19 is also arranged in the plane of the poles of the cores 2 of the electromagnets and from such systems selectively either printing heads with the magnets arranged in an annular shape with one or several rows of printing needles one on top of each other or also line printers may be provided by arranging the systems adjacent to each other.

While specific embodiments have been shown and described in detail to illustrate the application of the inventive principles, it will be understood that the invention may be embodied otherwise without departing from such principles.

What is claimed is:

1. A needle printing device comprising a base plate of magnetic material, a plurality of printing needles, electromagnetic means including core means operating to individually actuate said printing needles, permanent magnet means, yoke means defining a magnetic flux path between said electromagnetic means and said permanent magnet means, armature means, and spring means connecting with said armature means and having said printing needles attached thereto, said armature means being held against said core means in a first position by said permanent magnet means against the force of said spring means when said electromagnetic means is de-energized, with energization of said electromagnetic means operating to cause said printing needles and said armature means to move toward a printing position under the influence of said spring means, said yoke means including a first and a second yoke part, with said second yoke part having said armature means arranged thereon, said first yoke part and said core means having, respectively, a first and a second coplanar surface, said first and second coplanar surfaces being arranged to extend in a first common plane, said armature means and said second yoke part having, respectively, a third and a fourth coplanar surface, said third and fourth coplanar surfaces being arranged to extend in a second common plane, said needle printing device being constructed so that when said electromagnetic means is de-energized with said armature means held in said first position said second common plane is immediately adjacent and parallel to said first common plane and said third coplanar surface of said armature means and said second coplanar surface of said core means lie parallel with and flat against each other in abutting relationship.

2. A device according to claim 1 further comprising dampening detent means for said armature means having a fifth coplanar surface which lies in a common plane with said first and second coplanar surfaces of said first yoke and said core means.

3. A device according to claim 1 wherein said second yoke part is composed of a plurality of second yoke members, wherein said armature means is composed of a plurality of armature members each individually mounted with one of said second yoke members, said spring means comprising a plurality of spring members each arranged with one each of said second yoke members and armature members so that an exact minimum air gap is maintained between each of said armature members and a surrounding second yoke member.

4. A device according to claim 3 wherein each of said spring members is made of an elongate steel piece formed with a plurality of necked portions, with one of said necked portions being arranged in a recess of a second yoke member so as to stabilize movement of said armature to stabilize said air gap and with another of said necked portions extending transversely to said one necked portion and having a printing needle attached thereto.

5. A device according to claim 1 wherein a plurality of said needle printing devices are assembled together to form a needle print unit with said first yoke means being arranged on a first diameter and with said electromagnetic means being arranged on a second diameter inwardly of said first diameter with a dampening detent being arranged in the center of said first diameter.

6. A device according to claim 1 wherein said permanent magnet means comprises an annular magnet which is axially magnetized.

7. A device according to claim 1 wherein said electromagnetic means comprise a plurality of electromagnets and wherein said first yoke part comprises an annular yoke member surrounding said electromagnets.

8. A device according to claim 1 wherein said electromagnetic means comprise a plurality of electromagnets, wherein said permanent magnet means comprise a plurality of permanent magnets, and wherein said first yoke part comprises a plurality of first yoke members, each of said electromagnets, said permanent magnets and said first yoke members being individually associated with each other.

9. A device according to claim 1 formed with a generally circular configuration having said electromagnetic means comprised of a plurality of electromagnets arranged in a generally circular pattern with a dampening detent being arranged at the center of said circular pattern, said dampening detent being adapted to engage said spring means when said armature means is in said first position.

10. A device according to claim 1 wherein said plurality of printing needles are arranged in a single row to form a line printer.

11. A device according to claim 1 wherein said base plate, cores of said electromagnetic means, said permanent magnet means and said first yoke part are preassembled as a single unit.

12. A device according to claim 1 wherein during assembly thereof said spring means is first provided with a first necked portion, said spring means is subsequently pushed into a recess in said second yoke part until it is engaged therein in a pressed fit, said armature means is pushed over said spring means until it is fastened thereto in a pressed fit and thereafter a second necked portion is formed on said spring means with said printing needles being soldered thereafter to said second necked portion.

* * * * *